United States Patent [19]

Jouve et al.

[11] 4,227,947

[45] Oct. 14, 1980

[54] METHOD FOR MODIFYING THE EASY DIRECTION OF MAGNETIZATION OF AN AMORPHOUS MAGNETIC FILM

[75] Inventors: Hubert Jouve, Biviers; Robert Meyer, Gieres; Jacques Sztern, Meudon-la-Forêt; Ramanathan Krishnan, Malakoff; Gabor Suran, Fontenay-aux-Roses; Michel Tessier, Trappes, all of France

[73] Assignees: Commissariat a l'Energie Atomique, Paris; Agence Nationale de Valorisation de la Recherche (ANVAR), Neuilly-sur-Seine, both of France

[21] Appl. No.: 928,836

[22] Filed: Jul. 28, 1978 (Under 37 CFR 1.47)

[30] Foreign Application Priority Data

Aug. 4, 1977 [FR] France ..... 77 24041

[51] Int. Cl.[3] ..... H01F 1/00

[52] U.S. Cl. ..... 148/122; 148/31.55

[58] Field of Search ..... 148/13, 16, 16.7, 20.3, 148/121, 122, 31.55, 31.57

[56] References Cited

U.S. PATENT DOCUMENTS

| | | | |
|---|---|---|---|
| 4,137,075 | 1/1979 | Ray et al. | 75/122 |
| 4,140,525 | 2/1979 | Ray | 75/126 C |

OTHER PUBLICATIONS

Journal of Applied Physics, vol. 45, No. 9, Sep. 1974, Hasegawa et al.

*Primary Examiner*—L. Dewayne Rutledge
*Assistant Examiner*—John P. Sheehan
*Attorney, Agent, or Firm*—Kerkam, Stowell, Kondracki & Clarke

[57] ABSTRACT

The easy direction of magnetization of an amorphous magnetic film is brought in the plane of the film by annealing this film in an oxygen-free atmosphere composed of a gas selected from the group comprising argon, neon, krypton and xenon at a temperature below the temperature of crystallization of the alloy which constitutes the film. The depth of penetration of the rare gas into the film is adjusted by modifying the parameters of annealing temperature and time in order to modify the easy direction of magnetization to a greater or lesser depth within the film.

2 Claims, 10 Drawing Figures

Figure 1A:
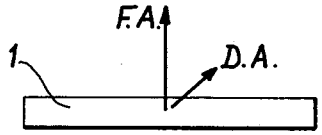

METHOD FOR MODIFYING THE EASY DIRECTION OF MAGNETIZATION OF AN AMORPHOUS MAGNETIC FILM

This invention generally relates to magnetic-film devices, especially to devices having an amorphous structure and provided at the time of fabrication with an easy direction of magnetization perpendicular to the plane of the film itself.

Amorphous magnetic films which usually have a thickness within the range of 1000 Å to 30,000 Å are generally known and have many applications in the field of magnetism, especially in measuring techniques as well as storage techniques. In the majority of instances, films of this type are obtained by subjecting an amorphous material of the rare-earth series alloyed with transition metals to diode sputtering in an argon atmosphere, this deposition being carried out on a magnetically inert substrate. Amorphous magnetic films having a greater thickness of the order of a few microns are also commonly employed for the same applications. These films are obtained in the form of strips or ribbons produced by ultra-rapid quenching from a molten alloy of a metal and a metalloid. This is the case, for example, with the ribbon produced commercially under the name of "Metglas" by Allied Chemical Corporation in the U.S.A. and formed of alloys of iron and boron corresponding to the general formula $Fe_{80}B_{20}$.

The value which characterizes a magnetic film of this type from the standpoint of magnetic anisotropy is the anisotropy energy $Ku=\frac{1}{2}MH_a$, where M is the magnetization and $H_a$ is the anisotropy field.

In the magnetic films which are at present commonly available in commerce, the sign of the anisotropy energy Ku is a function of the method of preparation and of the composition and is representative of the position of the easy direction of magnetization with respect to the plane of the film. As is most commonly the case, Ku is negative and the easy axis of magnetization is perpendicular to the plane of the film. In point of fact, it can be highly advantageous in a number of applications in the field of measurements, storage devices or integrated optics to provide a thin film whose easy axis of magnetization is located in the actual plane of the film. Unfortunately, no known method in existence up to the present time had made it possible to modify the sign of Ku.

In the prior art, annealing treatments in an argon, air or nitrogen atmosphere have been carried out on amorphous magnetic films of this type, especially by the IBM Corporation. The only effect observed up to the present time was a reduction in the perpendicular anisotropy energy as well as a reduction in the value of the coercive field. Argon ion implantations have also been performed by IBM and have similarly led to the observation of a reduction in perpendicular anisotropy energy at right angles to the plane of the film. Moreover, in the particular case in which this implantation was performed in the presence of a magnetic field perpendicular to the film, there was observed on the contrary an increase in the perpendicular anisotropy energy. All these effects have been interpreted up to the present time as being attributable to disordering of the atomic structure or to the creation of cobalt atom pairs.

The present Applicants have found in a novel and unexpected manner that, by subjecting an amorphous film to annealing in an oxygen-free atmosphere composed of a rare gas selected from the group comprising argon, neon, krypton and xenon at a temerature below the temperature of crystallization of the alloy which constitutes the film and during a period within the range of 10 to 24 hours, the easy direction of magnetization could be modified and brought in the plane of said film.

This method achieves results which are wholly unexpected in comparison with those observed in the prior art when annealing in an argon atmosphere. A distinctive and very important feature of the method in fact lies in the possibility of adjusting the depth of penetration of the rare gas into the film at will by modifying the parameters of annealing temperature and time, thereby making it possible to ensure that the easy axis of magnetization is located in the same plane as the film to at least a part of the depth of said film which is predetermined according to requirements. In accordance with the experiments which have been conducted, the maximum depth of penetration is of the order of 0.2 micron and is exactly determined by selecting an annealing temperature and time of greater or lesser value.

It has also been found experimentally that the execution of the method calls for an atmosphere which is completely free of oxygen in order to prevent any phenomenon of oxidation which would be liable to modify to any appreciable extent or even to destroy the magnetic properties of the film. To this end and in accordance with the invention, the method calls either for powerful and continuous sweeping of the reaction chamber with rare gas of high purity or, in the most frequent case in which a closed evacuated vessel is employed, for emptying and filling said vessel with rare gas at least twice before introducing into this latter the pure gas which will finally be employed.

To this end, the method for modifying the easy direction of magnetization of an amorphous magnetic film in accordance with the invention essentially consists in introducing the amorphous magnetic material into a sealed vessel in which the initial step consists in creating a vacuum of at least $10^{-7}$ mmHg, then in introducing the pure rare gas at the pressure of one atmosphere; a vacuum of the order of $10^{-5}$ mmHg is again created and the pure rare gas is again introduced at the pressure of one atmosphere, whereupon the sample is heated to a temperature within the range of 50° to 220° C. for a period of the order of 10 to 24 hours.

The amorphous magnetic material employed can have the general formula $AB_x$, where A is a rare earth selected from the group comprising yttrium, gadolinium and holmium, B is cobalt and x is a number such that $2<x<2$, said material being obtained by sputtering in argon on a substrate.

This material can also be an alloy formed by a transition metal and a metalloid and fabricated in the form of a ribbon by ultra-rapid quenching from the molten alloy. In the case just mentioned, a particularly advantageous alloy is formed by iron and boron and has the composition $Fe_{80}B_{20}$.

A more complete understanding of the invention will in any case be gained from the following description which is given without any limitation being implied and relates to a number of examples of execution of the method. Reference will be made to the accompanying drawings in which the numerals bearing the index a represent the state of the films prior to application of the method in accordance with the invention and the numerals bearing the index b represent the state of the same films after application of the method.

Figure 1B:
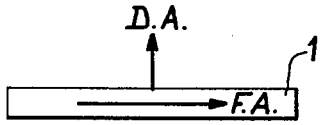

In these drawings:

FIGS. 1*a* and 1*b* respectively, depict a film before and after treatment to its full depth in accordance with the instant invention.

Figure 2A:
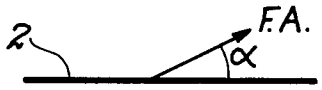
Figure 2B:
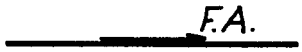

FIGS. 2*a* and 2*b* respectively, depict a ribbon of $Fe_{80}B_{20}$ before and after treatment in accordance with the instant invention.

Figure 3A:
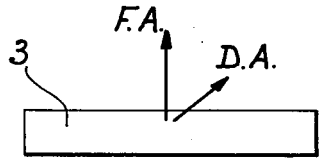
Figure 3B:
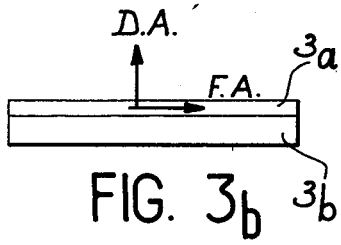

FIGS. 3*a* and 3*b* respectively, depict a ribbon before and after treatment to less than its full depth.

Figure 4A:
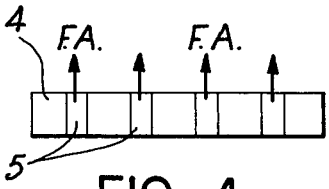
Figure 4B:
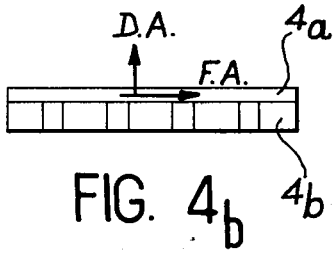

FIGS. 4*a* and 4*b* respectively, depict a bubble storage device before and after treatment to only part of its depth.

Figure 5A:
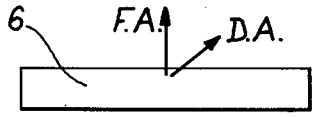
Figure 5B:
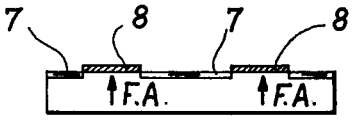

FIGS. 5*a* and 5*b* respectively, depict a film before and after treatment in the presence of a certain number of local masks.

There is illustrated in FIG. 1*a* an amorphous magnetic film 1 in which the easy direction of magnetization FA is perpendicular to the plane of the film 1 and the hard direction of magnetization DA can be any direction with respect to said film. By applying the method in accordance with the invention, said film is converted to the state shown in FIG. 1*b* in which the easy direction of magnetization is contained in the plane of the film and in which the hard direction of magnetization is perpendicular to the plane of said film. Correlatively, there is also obtained a substantial reduction of the coercive field which is much weaker in the film of FIG. 1*b*; and one of the consequences of the treatment is also to increase to a substantial extent (for example from 600 to 2000 gauss) the field which is necessary in order to obtain saturation magnetization in the hard direction of magnetization.

FIG. 2*a* relates to a magnetic ribbon 2 which is prepared by ultra-rapid quenching and in which the easy direction of magnetization makes a small angle alpha with the plane of the ribbon. By treating said ribbon by means of the method in accordance with the invention, the state thus achieved is shown in FIG. 2*b* in which the easy direction of magnetization coincides with the plane of the ribbon.

In the two examples given above, it has been assumed that the annealing conditions adopted (temperature, pressure and time-duration) were such that the penetration of argon affected the entire depth or thickness of the film, with the result that this latter did not exceed a value substantially equal to 0.2 micron. On the contrary, in the following examples, the film has a thickness which is greater than 0.2 micron or, alternatively, the conditions of annealing temperature and time and possibly pressure are regulated so as to ensure that the conversion produced by penetration of the argon does not affect the entire thickness of the film.

FIG. 3*a* illustrates a magnetic film 3 on which the easy direction of magnetization and the hard direction of magnetization are shown in the direction of the arrows FA and DA, the easy axis being assumed to be perpendicular to the plane of the film 3.

The application of the method in accordance with the invention results in achievement of the state shown in FIG. 3*b* in which the film 3 is divided into two portions 3*a* and 3*b* in the direction of the thickness of this latter. The portion 3*b* remains magnetically identical with the state of the film 3 prior to treatment; in the portion 3*a* which is alone subjected to annealing in argon, an easy direction of magnetization and a hard direction of magnetization are observed, these directions being designated respectively by the references FA and DA in the figure, the direction FA being located in the plane of the film 3a.

Finally, FIG. 4*a* relates to the very advantageous example of a bubble-type film 4, namely a film containing a number of small zones 5 or magnetic domains, the diameter of which is of the order of 1 to 3 microns whilst the height which is equal to the thickness of the film 4 is of the order of 1 to 5 microns. Each zone has an easy direction of magnetization which is perpendicular to the surface but is characteristic of said zone whereas adjacent zones have easy directions of magnetization which are parallel but opposite. Films of this type are commonly employed in storage techniques since they make it possible to write a large number of binary digits on a very small surface. In certain particular applications of these bubbledomain storage devices, it proves advantageous to subject said devices to the annealing treatment in accordance with the invention to only a part of their depth corresponding to the portion 4*a* whilst the portion 4*b* remains in the prior magnetic state. FIG. 4*b* consequently shows the very special structure thus obtained and comprising a first film layer 4*a* in which the easy direction of magnetization is contained in the plane of the film layer 4*a* and the hard direction of magnetization is perpendicular to this layer, and a second film layer 4*b* having a general structure which is identical with that of the film 4 prior to application of the treatment.

Finally, a further advantageous example of application of the annealing method in accordance with the invention is worthy of mention, namely the possibility of selectively forming plane-magnetization zones 7 in a film of the type designated by the reference 6 in FIG. 5*a* by protecting the film surface at the moment of application of the treatment by means of very small masking elements 8 of $SiO_2$, for example, said elements being deposited by the photoetching process. While preventing penetration of argon into the zones 9 protected by the masking elements 8 (as shown in FIG. 5*b*), said elements leave the corresponding zones 9 in the initial state while preventing conversion of the easy direction of magnetization.

The presence of a plane-magnetization film at the surface of a bubble material in the magnetic films obtained in accordance with the method of the invention is very useful in three principal applications:

(1) In the event that bubble propagation takes place by means of Fe-Ni patterns added on top of the bubble material, this film serves to suppress the hard bubbles which prevent normal operation of the memory or storage device.

(2) In the case of the bubble-array device, this film serves to control the state of walls which permits coding of the information.

(3) Finally, in the event that propagation takes place around contiguous discs beneath which the formation of a plane-magnetization film has been prevented, said film permits the formation of charged walls which displace the bubbles.

In the case of all these experiments, the anisotropy of the samples prior to and after treatment has been measured by employing the known technique of ferromagnetic resonance. To this end, a measurement is taken of the perpendicular resonance field H along the direction which is perpendicular to the plane of the film or ribbon and of the parallel resonance field H along the direction which is parallel to the plane of the film. In the case of all the samples, the annealing operation takes place as follows: the sample is placed within a glass container in which the pressure can be reduced to a value at least equal to $10^{-7}$ mmHg. When a pressure of this order is attained, pure argon is introduced at a pressure of one atmosphere. This pressure is again reduced to a value of $10^{-5}$ mmHg and the container is finally filled with pure argon at a pressure of one atmosphere. The aim of all these operations is to ensure that any trace of oxygen is completely removed from the interior of the glass container. The annealing operation proper can then take place by heating the sample to a temperature which is usually within the range of 50° C. to 220° C., the maximum temperature adopted being always considerably lower than that of the crystallization temperature in order to retain the amorphous character of the material which constitutes the thin film. The annealing time ranges from 10 hours to 24 hours but experience shows that an extension of this period does not have any appreciable influence on the value of the final anisotropy, which probably means that all the argon which could possibly be caused to penetrate into the film has in fact penetrated into this latter at the end of 24 hours.

The table given hereunder shows the anisotropy energy Ku expressed in $10^{-4}$ erg/cm$^3$. The first three samples are alloys of rare earths and of cobalt obtained by sputtering in an argon atmosphere with a bias voltage of 100 V, that is to say under comparable conditions. Only the thicknesses differ as recorded in the first column and the table shows the very considerable modification obtained in regard to the value of Ku after the operation of annealing in an argon atmosphere. It is established that this annealing treatment has the effect of changing the easy direction of magnetization since Ku which was negative prior to treatment then becomes positive. There is also observed a reduction in resonance line width in the case of ΔH (perpendicular) and ΔH (parallel). At the same time, a reduction of coercive field by a factor of 2 or 3 is observed. By studying the films of different thicknesses (from 0.2 to 1 micron), it has been possible to estimate the maximum depth of penetration of argon at approximately 0.2 micron under the conditions of experiment mentioned in the foregoing. This offers a very appreciable advantage since it is possible as shown in FIGS. 1 to 5 to obtain a final product in a variety of different forms by adjusting the extent of penetration of the argon into the film.

In the following table, the fourth example concerns a "Metglas" ribbon having a thickness of 20μ in which the values of anisotropy field $H_a$ increase from −1000 gauss to +500 gauss under the action of the annealing treatment in accordance with the invention.

| | | Anisotropy energy Ku in $10^4$ erg/cm$^3$ | | |
|---|---|---|---|---|
| FILM | Thickness in μm | Ku prior to treatment | Ku after annealing in argon | Bias voltage (at the time of production) |
| $YCo_3$ | 0.2 | + 7.6<br>+ 7.6 | − 44.7<br>− 38.6 | − 100 V |
| $YCo_3$ | 1.0 | + 4.8<br>+ 4.8 | − 54.7<br>− 53.2 | − 100 V |
| $GdCo_3$ | 0.7 | + 3.9 | − 15.1 | − 100 V |
| $Fe_{80}B_{20}$ | Metglas ribbon (20μ) | $H_a$ = −1000gauss | $H_a$ = +500gauss | |

The results have been obtained on another film of $YCo_3$ having a thickness of 0.5 μm annealed at 200° C. for a period of 24 hours in an atmosphere of neon, krypton, xenon and argon:

| Ku prior to annealing | Ku in erg/cm$^3$ after annealing at 200° C. for 24 hours in: | | | |
|---|---|---|---|---|
| | Ne | Kr | Xe | Ar |
| $+7.10^4$ | $-50.10^4$ | $-55.10^4$ | $-53.10^4$ | $-50.10^4$ |

What we claim is:

1. A method for modifying the easy direction of magnetization of an amorphous magnetic film of an alloy wherein annealing of said film is carried out in an oxygenfree atmosphere composed of a gas selected from the group consisting of argon, neon, krypton and xenon at a temperature below the temperature of crystallization of the alloy which forms said film, said alloy being in the form of a ribbon fabricated by ultra-rapid quenching from the molten alloy, the magnetic alloy being a transition metal and a metalloid of iron and boron and having the composition $Fe_{80}B_{20}$.

2. An amorphous magnetic film constituted by a material which is an alloy of a ferromagnetic metal with a metalloid, wherein the easy axis of magnetization is located in the same plane as the film to at least part of the depth of said film, wherein the alloy is composed of iron and boron and corresponds to the formula $Fe_{80}B_{20}$.

* * * * *